United States Patent [19]

Sagawa

[11] 4,122,575

[45] Oct. 31, 1978

[54] TUBE CLEANING MATERIAL

[75] Inventor: Teikichi Sagawa, Chigasaki, Japan

[73] Assignee: Nihon Pipeline Service Kabushiki Kiahsa, Tokyo, Japan

[21] Appl. No.: 794,735

[22] Filed: May 9, 1977

[51] Int. Cl.[2] ..... B08B 9/04

[52] U.S. Cl. ..... 15/104.06 R

[58] Field of Search ..... 15/104.06 R, 104.06 A, 15/3.5, 3.51

[56] References Cited

U.S. PATENT DOCUMENTS

| | | | |
|---|---|---|---|
| 1,634,094 | 6/1927 | Cook et al. | 15/104.06 R |
| 1,713,895 | 5/1929 | Ford | 15/104.06 R |

FOREIGN PATENT DOCUMENTS

| | | | |
|---|---|---|---|
| 522,895 | 4/1931 | Fed. Rep. of Germany | 15/104.06 |

*Primary Examiner*—Edward L. Roberts
*Attorney, Agent, or Firm*—Basile and Weintraub

[57] ABSTRACT

A tube cleaning material for cleaning the inside of a tube is adapted to be passed through such a tube by means of a back pressure. The tube cleaning material includes a cylindrical body provided with at least one, and, preferably, a plurality of spiral grooves formed in its peripheral surface. The grooves extend and run in the same direction from the front to the rear of the cylindrical body. The edges of the groove are brought close to each other, when the material is pressed into the tube, so as to prevent wrinkles from appearing on the surface of the material. In addition, the grooves allow the back pressure creating medium to go ahead of the body to moisten the sticking contaminants on the tube. This facilitates the removal of contaminants especially when the medium is water. The body is rendered rotatable by the fluid medium. In one embodiment of the invention the grooves of one side communicate with the grooves on the other side of the body by a bore diametrically extending through the body. This facilitates the attaching of an auxiliary cleaning tool to the cylindrical body.

3 Claims, 10 Drawing Figures

TUBE CLEANING MATERIAL

BACKGROUND OF THE INVENTION

1. Field of the Invention

The present invention relates to a tube cleaning material adapted to be passed through a liquid or gas transporting tube, with back pressure for cleaning the inside of the tube.

2. Prior Art

Various types of tube cleaning materials for cleaning the interior of liquid and gas transport tubes have been proposed.

Typifying one of the conventional types is a cylindrical body on which a reinforcing resin is spirally applied. Another tube cleaning material has a plurality of flange-shaped reinforcers formed on the peripheral surface of a cylindrical body. These materials have a diameter slightly larger than the inner diameter of the tube to be cleaned, and are adapted to be forced into and passed forcibly through the tube by means of a back pressure applied to the trailing side of the body.

It has been observed, however, that the cleaning material of the first mentioned type is apt to cause axially extending wrinkles in its outer peripheral surface. This is due to compression within the tube. Furthermore, this type material is moved without substantial revolution or rotation through the tube, resulting in an uneven contact of the material surface and the tube inner surface, thereby leaving considerable sticking contaminants unremoved. Additionally, the material is locally worn excessively at its surface, inconveniently shortening the life thereof. Thus, the effective distance of travel within the tube is impractically shortened.

With respect to the second mentioned type of material, the spaces between the adjacent reinforcing flanges may change because of the friction between the peripheral surfaces of the reinforcing flanges and the tube surface, which varies depending on the flanges. This may, ultimately, result in breakage of the connection between the reinforcing flange and the cylindrical body. In addition, as is the case of the first mentioned type, no rotation of the material within the tube can be expected. This leaves some area of the tube surface untouched by the material and, therefore, uncleaned.

The invention provides, as a result of an intense study, solutions to the problems as mentioned above which are inherent in the conventional tube cleaning materials.

OBJECTS OF THE INVENTION

It is, therefore, an object of the invention to provide a tube cleaning material which does not cause wrinkles, when press-fitted into a tube, having an inner diameter smaller than the outer diameter of the material, to ensure an even contact of the material surface with the tube surface to promote an even removal of the sticking contaminants, and which can be used for a longer period due to an even wearing down.

It is another object of the invention to provide a tube cleaning material which is adapted to be rotated during passage through the tube, so as to change the line of contact from a straight line to a curved one, thereby increasing the friction area to, thus, ensure a larger polishing effect.

It is still another object of the invention to provide a tube cleaning material which, when water is used as the back pressure medium, allows the water to go ahead of the material itself, so that the soft sticking contaminants may be softened and delaminated and the hard sticking contaminants may be moistened for an easier removal to ensure a larger polishing effect.

It is a further object of the invention to provide a tube cleaning material which is deformable in the circumferential direction to enable it to be passed through tubes of different diameters.

It is a still further object of the invention to provide a tube cleaning material adapted to be connected at its front or rear side to an auxiliary cleaning tool, by means of a string which does not appear on the peripheral surface of the material body to thereby provide an increased cleaning and polishing effect and, wherein the breakage of the string is avoided, preventing the auxiliary cleaning tool from being left in the tube accidentally.

SUMMARY OF THE INVENTION

The tube cleaning material of this invention is of a type so-called pipeline-pig, and has a compressible or deformable elastic body made of a material such as polyurethane foam. The material has at least one spiral groove formed in its periphery running from the front to the rear side or end of the body. Where plural grooves are utilized, they extend in the same direction.

In accordance with the present invention when a back pressure is applied to the material, a thrusting force is exerted on the inclined surface of the spiral groove to cause the rotation of the material. In addition, when water is used for the back pressure medium, the water is allowed to go ahead of the cleaning material through the spiral grooves to moisten and, in some cases, remove the sticking contaminants, in advance of the passage of the cleaning material itself. This promotes and enhances the cleaning and polishing effects of the material.

In an alternate embodiment of the invention, a tubular string is wound around the bottom of the groove. Alternatively, a string having a diameter small enough to maintain a gap between itself and the wall of the groove may be passed through the groove. With plural grooves, they are in communication with each other by a bore extending diametrically through the body. The string is passed through the bore to facilitate the attaching of the auxiliary cleaning tool to the material.

The object, as well as advantageous features of the present invention will be more fully understood from the following description of the preferred embodiments taken in conjunction with the attached drawings in which:

DESCRIPTION OF THE PREFERRED EMBODIMENTS

Figure 1A:
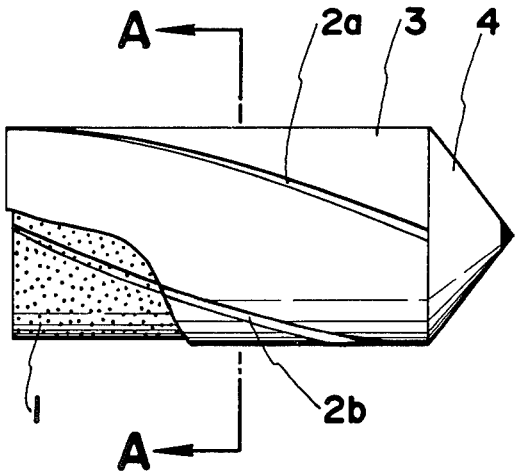
FIG. 1A is a side elevational view of a tube cleaning material embodying the present invention, with a part thereof having been removed.
Figure 1B:
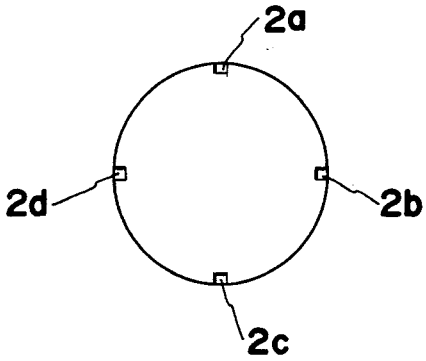
FIG. 1B is a back elevational view of the tube cleaning material of FIG. 1A.
Figure 1C:
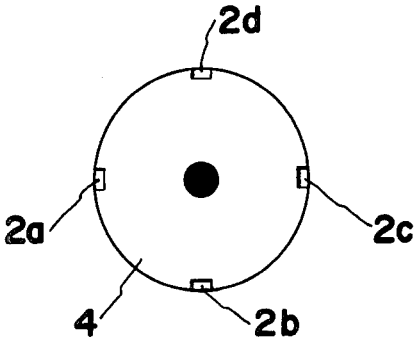
FIG. 1C is a front elevational view.
Figure 1D:
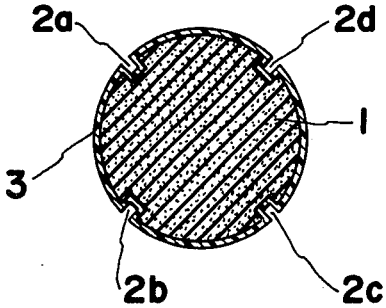
FIG. 1D is a sectional view taken along the line A—A of FIG. 1A.
Figure 2A:
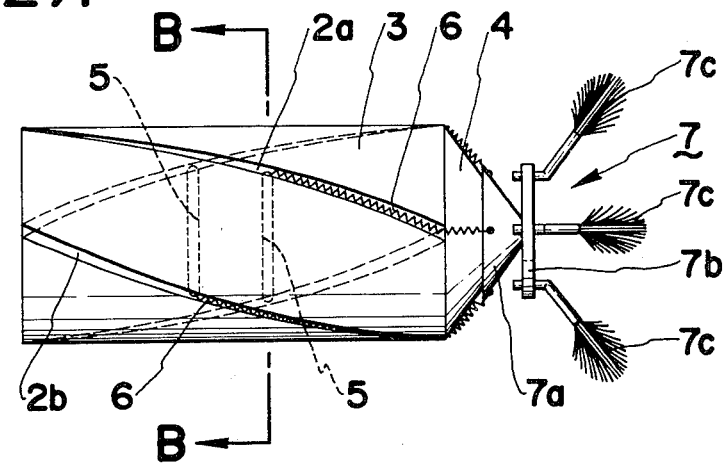
FIG. 2A shows the tube cleaning material having an auxiliary cleaning tool attached thereto.
Figure 2B:
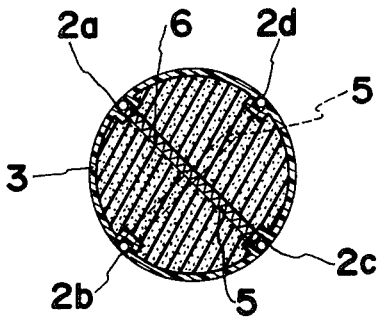
FIG. 2B is a sectional view taken along the line B—B of FIG. 2A.
Figure 2C:
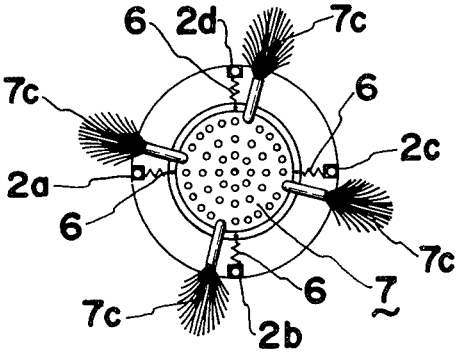
FIG. 2C is a sectional view taken along the line B—B of FIG. 2A.
Figure 3A:
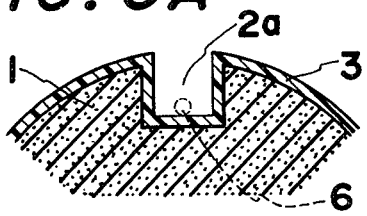
FIG. 3A shows a groove before use of the tube cleaning material.
Figure 3B:
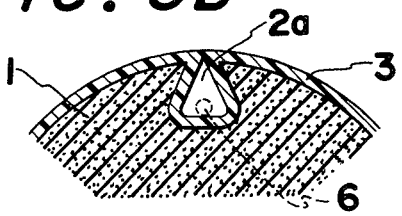
FIG. 3B shows the groove during the use of the material.
Figure 3C:
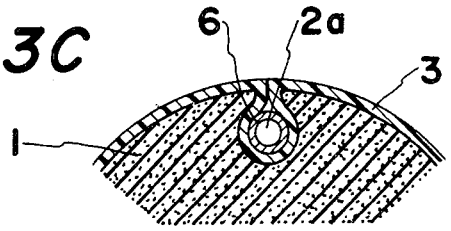
FIG. 3C shows a groove during the use of the tube cleaning material in combination with a string in the form of a coil.

Referring to FIG. 1, there is depicted a cylindrical body 1 of a tube cleaning material in accordance herewith. The body 1 is made of a compressible elastic material and has a diameter slightly larger than the inner diameter of a tube to be cleaned.

Four spiral grooves *2a, 2b, 2c* and *2d* run in the same direction over the front and the rear sides of the body 1, along the peripheral surface thereof.

A reinforcing member or polishing member 3 is provided on the peripheral surface of the cylindrical body 1.

It should be noted that the elastic material from which the body 1 is made should have a sufficient elasticity to allow the running of the tube cleaning material through the tube to enable the latter in combination with the polishing member 3, to remove the sticking contaminants on the inner surface of the tube. The body 1 is usually formed of natural rubber or a foamed body of a synthetic rubber such as nitrile rubber. Alternatively, the body 1 can comprise a polyurethane foam.

Also, although the cylindrical body 1 is illustrated and described as having four grooves *2a* to *2d*, the number of the grooves is not critical hereto. Thus, any number of grooves can be utilized.

In practicing the present invention, the pitch of the groove can be selected to provide an optimum running speed and rotational speed, depending upon the tube length; the diameter of the tube; the nature of the contaminants to be removed and other factors. In the drawing, each groove in the drawings makes a quarter of a turn around the cylindrical body over its entire length, but, again, this is not to be construed as limitative of the invention.

Preferably, the depth and the width of the groove or grooves *2a, 2b, 2c* and *2d* are so dimensioned that they get progressively smaller toward the rear, i.e. the trailing side of the body. This facilitates the insertion of the tube cleaning material from a tube of a larger diameter to that of a smaller diameter because of the larger compressibility at the front, i.e. the leading side. This dimensioning of the grooves smoothens the running of the tube cleaning material.

The reinforcing member or the polishing member 3 on the surface deposited or otherwise disposed on the body comprises a material containing a plastic having a polishing nature or a granular polishing material. The polishing member 3 may be applied only to a portion of the surface of the cylindrical body or to the entire surface, as illustrated.

A projection 4 may be formed on the front end as well as on the rear end of the cylindrical body, although not shown. Furthermore, either end surface may be flattened or recessed.

The tube cleaning material is inserted into a tube and is forced to run therethrough by a back pressure. This causes the peripheral reinforcing member or polishing member 3 to scrape the sticking contaminants off from the inner wall of the tube. During passage through the tube, the tube cleaning material, which has an outer diameter larger than the inner diameter of the tube, is compressed circumferentially. However, the compression leaves no wrinkles on the surface of the cylindrical body because the edges of each groove *2a* to *2d* absorb the shrinkage caused by the compression. However, the gas or liquid acting as the back pressure medium is still permitted to get in front of the tube cleaning material because the grooves are collapsed only at their top, i.e. peripheral portions with their bottoms maintaining or perserving the original width.

As the back pressure medium passes through the grooves, the velocity is increased due to the decreased sectional area of passage. This, in turn, acts to cause a rotation of the tube cleaning material due to the spiral nature of the grooves.

Assuming that a liquid is used as the back pressure medium, it passes through the grooves to get in front of the tube cleaning material to delaminate the soft sticking contaminants from the tube wall and to moisten the hard contaminants for an easier removal in advance of the tube cleaning material.

It will be understood that the larger dimension of the spiral grooves allows a larger compression of the tube cleaning material for enabling the latter to run through a smaller tube smoothly.

Referring now to FIGS. *2a, 2b* and *2c*, bores 5 diametrically pass through the cylindrical body 1 to provide mutual intercommunication for the spiral grooves *2a, 2b, 2c* and *2d*. Strings 6 are passed through the bores 5 and the spiral grooves *2a–2d*. The strings are used to secure an auxiliary cleaning tool 7, described hereinbelow, to the tube cleaning material. The strings 6 do not appear or project from the surface of the cylindrical body. They are completely received within the spiral grooves *2a–2d* and the bores 5. The strings 6 should be of a stiff material such as a metal. The use of a coiled string 6 as shown in FIG. *3c* is preferred since it can preserve a passage of liquid through the bottom of the grooves, when the cylindrical body is compressed.

The auxiliary cleaning tool 7 has a plate *7b* provided with a number of bores. The plate *7b* is attached to a fitting *7a*. The plate *7b* carries brushes *7c* which extend outwardly toward the inner surface of the tube. The brushes *7c* scrape the sticking contaminants, prior the passage of the tube cleaning material, so as to improve the tube cleaning and polishing efficiency. Other types of cleaning tools can be deployed and can be mounted on the rear end of the cylindrical body, as well as on the front end.

Since the string 6 does not emerge from the surface of the cylindrical body, it is less likely to be damaged nor does it damage the tube wall. In addition, because the string 6 need not be large, it occupies only a small portion of the groove section.

Even when the grooves are subjected to a large compression, it is possible to preserve a sufficiently large passage for the back pressure medium at the bottom of the groove by the use of the coiled wire as the string 6.

In practicing the present invention, the most effective cleaning will be obtained when the use of a front auxiliary cleaning tool is combined with the use of the liquid as the back pressure medium because the removal of the contaminants by the auxiliary cleaning tool is encouraged by the liquid spray at the leading side of the tube cleaning material.

In utilizing the present invention, no wrinkles are caused in the peripheral surface of the tube cleaning material, even when it is passed through a tube of a smaller diameter and while being forced ahead by a back pressure, which allows the entire surface of the material to contact the inner surface of the tube. This ensures an even removal of the sticking contaminants and, at the same time, an improved durability of the cleaning material due to an even wearing down over the surface of the material.

In addition, the direction or line of friction is curved, due to the rotation of the tube cleaning material, which provides a larger area of frictional contact, resulting in an increased cleaning and polishing effect.

Furthermore, when water is used as the back pressure medium, the water is allowed to go ahead of the tube cleaning material to delaminate the soft sticking contaminants and moisten the hard contaminants for an easier removal of the cleaning body, in advance of the passage of the cleaning body, contributing, also, to improval cleaning and polishing.

Also, the compressibility of the tube cleaning material is conveniently increased by suitably selecting the dimension of the groove, so as to render the tube cleaning material applicable to tubes of different diameters.

In addition, due to the use of the string, which can be engaged with the cleaning material without projecting outwardly therefrom, an auxiliary cleaning tool can be easily attached without causing damage to the string itself or the inner surface of the tube.

Having, thus, described the invention what is claimed is:

1. A tube cleaning material comprising:
(a) a cylindrical body, the body being formed from a compressible elastic material and having a diameter somewhat larger than the inner diameter of a tube to be cleaned;
(b) at least one spiral groove in the peripheral surface of said cylindrical body extending in the same direction from the front to the rear end of said cylindrical body, and
(c) a polishing member provided on the surface of said cylindrical body,
wherein said groove has a width and depth which are increasingly larger toward the front end of said cylindrical body.

2. A tube cleaning material comprising:
a cylindrical body, the body being formed from a compressible elastic material and having a diameter somewhat larger than the inner diameter of a tube to be cleaned,
(b) grooving in the peripheral surface of said cylindrical body comprising a plurality of spiral grooves in the peripheral surface of said body extending in the same direction and from the front to the rear end of said body,
(c) a bore passing through said cylindrical body for providing a communication between said grooving from one peripheral surface area to another peripheral surface area of said body,
(d) at least one string passing through said grooving and said bore,
(e) an auxiliary cleaning tool secured to said cylindrical body at one end thereof by means of said string, and
(f) a polishing member provided on the surface of said cylindrical body.

3. A tube cleaning material comprising:
(a) a cylindrical body being formed from a compressible elastic material and having a diameter somewhat larger than the inner diameter of a tube to be cleaned,
(b) a plurality of spiral grooves formed in the peripheral surface of said cylindrical body and extending in the same direction from the front to the rear end of said cylindrical body,
(c) a bore passing through said cylindrical body for providing communication between one groove at one peripheral surface area of said cylindrical body and another groove at another peripheral surface area of the body,
(d) a hollow string comprising a coiled wire, the string passing through said grooves and said bore,
(e) an auxiliary cleaning tool attached to one end of said cylindrical body by means of said string, and
(f) a polishing member mounted on the surface of said cylindrical body.

* * * * *